United States Patent [19]

Hartai

[11] Patent Number: 5,041,762

[45] Date of Patent: Aug. 20, 1991

[54] LUMINOUS PANEL

[76] Inventor: Julius Hartai, Betsy Kjeldsbergsvei 232C, N-3028 Drammen, Norway

[21] Appl. No.: 476,370

[22] PCT Filed: Nov. 25, 1988

[86] PCT No.: PCT/NO88/00088

§ 371 Date: Jul. 26, 1990

§ 102(e) Date: Jul. 26, 1990

[87] PCT Pub. No.: WO89/05037

PCT Pub. Date: Jun. 1, 1989

[30] Foreign Application Priority Data

Nov. 27, 1987 [NO] Norway ..... 874963

[51] Int. Cl.[5] ..... H01J 33/00

[52] U.S. Cl. ..... 315/169.3; 313/493; 313/634

[58] Field of Search ..... 315/169.3, 169.4; 313/484, 485, 493, 634

[56] References Cited

U.S. PATENT DOCUMENTS 4,584,501 4/1986 Cocks et al. ..... 313/493

*Primary Examiner*—Robert J. Pascal

*Attorney, Agent, or Firm*—Griffin Branigan & Butler

[57] ABSTRACT

A luminous panel (1) with light channels (3) and wherein the light source preferably is based on gas discharge, comprises a gas tight, shockproof, impact resistant, transparent or translucent material, the light source being designed as a light channel (3) in a matrix (2). The matrix is doped with at least one phosphor, the phosphor having a controlled distribution in the matrix. The light channel (3) is designed integral with the luminous panel (1) and made substantially of the same material as this. The matrix (2) of the luminous panel (1) may be surrounded by sheets or layers (5) of hardened, shockproof, impact resistant, transparent or translucent material. The matrix (2) is preferably of glass, polymer or ceramic material.

25 Claims, 1 Drawing Sheet

LUMINOUS PANEL

The present invention relates to a luminous panel, with a light source based on gas discharge, wherein the luminous panel comprises a matrix in the form of a gas tight, shockproof, impact resistant, transparent or translucent material, and the light source is designed as at least one light channel in the matrix. More particularly the invention concerns luminous panels of the above-mentioned type with luminous areas which may have arbitrary geometry and extent and wherein their length and shape essentially are limited by the geometry and dimensions of the luminous panel.

Luminous panels of this type may be used both indoors and outdoors for ordinary lighting purposes, but will be especially well suited for decorative illumination, including in art objects, light sculptures and decoration on building structures etc. Especially the panel will also be suited as marking and security lighting, where they may be exposed to mechanical and environmental stresses that would make conventional light sources unsuitable. Among such uses there may be mentioned lighting for marking road shoulders, traffic lanes, traffic zones of different kind, including pedestrian zones and pavement shoulders and marking lights on runways and taxi strips for aircrafts. Further is may be mentioned that the panels are well suited as stairway lighting and corridor lighting, as they may be built into floors, walls, steps, banisters etc. Still further the luminous panels may be employed in sports installations, including swimming pools. In a particular embodiment the luminous panels may be used as traffic and wall signs, in larger displays and for advertising purposes.

As mentioned in the introduction, the light source of the luminous panels is preferably based on gas discharge. Light sources in the form of gas discharge tubes have previously been used for a plurality of the above-mentioned purposes, but if they are to be used in locations where they may be exposed to large mechanical and environmental stresses, this requires extensive measures when fitting the light source. Either expensive and to some extent complicated special light fittings must be used if they are not built into the object or on locations where they are put to use. This is also cost demanding and may additionally cause problems in connection with maintenance and replacement. The building in and securing of for instance gas discharge tubes against great external loads will furthermore have the disadvantage that they very often become less suited for the intended lighting purpose, for instance in that the light output is reduced due to fitting measures, that the illumination area is reduced and the use for a particular lighting purpose generally becomes suboptimal and less flexible. In addition the electrical connections and lines of the lighting source may in such cases offer problems, as an installation which protects against great external loads easily may complicate the electrical design, wiring, and the installation of units such as drivers, contacts and wires.

In several of the above-mentioned uses it would be desirable to use extended, flat light sources, i.e. light sources which do not appear as approximate points or lines or plane curves, but on the contrary as extended, flat light sources which give an essentially uniform light intensity over the total surface of the light source. By most known light sources this may only be achieved by mounting the light source in a fitting where the light openings comprise a material which is translucent to the light from the light source, and which further contributes to scatter the light and make it diffuse, in order that the material of the light opening appears as a uniform, luminous surface. Such measures will usually lead to a reduced light output and may further cause the same problems as mentioned above concerning the use of conventional light sources in environments which demand resistance against external loads. Examples of light sources of the above types may be found in for instance EP-A-222 928 and GB-A-2 165 344. The former discloses at least a low pressure arc discharge source embedded in a flat panel-like glass envelope, while the latter teaches a discharge tube embedded in a molded block of synthetic translucent resin.

Further there has for a long time been known surface lighting having a light source based on electroluminescence. Although electroluminescent light sources theoretically will deliver a high light yield, more than about 100 lumen/watt, in practice the hitherto achieved efficiency is a few lumen/watt. In comparison, an ordinary incandescent lamp yields about 15 lumen/watt or more, while a gas discharge tube based on fluorescence, i.e. light tubes, may yield more than 40 lumen/watt, which lies close to their maximum theoretical efficiency. In spite of this, electroluminescent light sources, for instance in the form of surface light source, i.e. electroluminescent panels, have to some degree been used for low effect illumination and in installations where high luminous intensity and high light yield are not essential, but where on the contrary small space demand and no heat generation are desirable, for instance for technical purposes and in various technical installations. Another problem with the most effective electroluminescent light sources is that the efficiency diminishes after a certain period of time, and consequently they must be changed quite frequently, even if they theoretically may have nearly unlimited time of life.

The objective of the present invention is to provide a light source which is well adapted to the applications mentioned in the introduction, and by which one additionally avoids the problems which are connected with the use of conventional light sources in such situations. This objective is according to the present invention achieved by providing a luminous panel with a a light source based on gas discharge, embedded in a matrix of a of, transparent and translucent material, the luminous panel being characterized in that the matrix is doped with at least one phosphor, and the phosphor having controlled distribution in the matrix.

The light panel may further comprise a plurality of light channels which are separately arranged in one or more layers in the matrix and given an arbitrary, desired external shape. Further the light channels may be made integral with the luminous panel and constructed of substantially the same material as the luminous panel, but may also be embedded in the luminous panel by casting or intrusion, for instance of a gas discharge tube.

Further features and advantages of a luminous panel according to the present invention are disclosed by the dependent claims 6 to 14.

Examples of preferred embodiments of a luminous panel according to the invention will be described more closely hereinafter with reference to the accompanying drawing.

Figure 1:
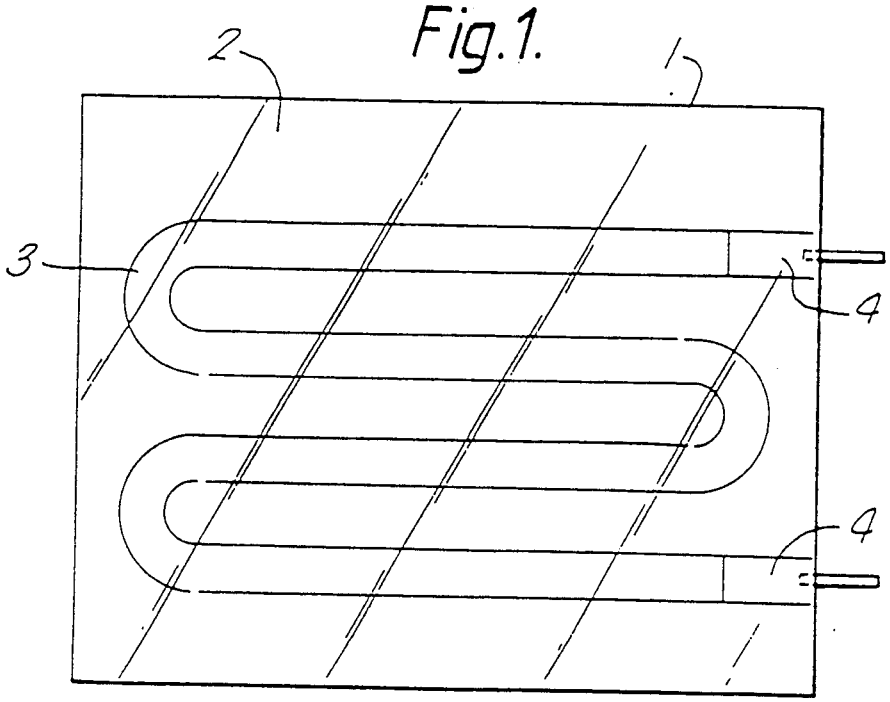
FIG. 1 shows a plan view of a luminous panel with light channels according to the invention.
Figure 2:
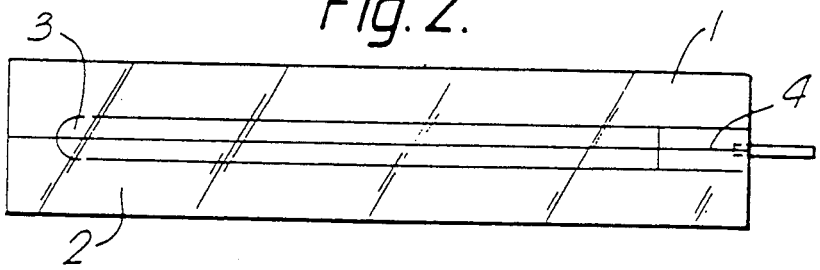
FIG. 2 shows an elevation view of a luminous panel as in FIG. 1 and with a light channel embedded in the matrix.

FIG. 1 shows a luminous panel, generally designated 1, according to the invention. It is shaped like a rectangular block or slab consisting of a matrix 2. In the matrix 2 there is formed a light channel 3. The light channel 3 may be formed as a cavity in the matrix 2 by for instance casting or a suitable machining method. In order to simplify the forming of the light channel 3 in the matrix 2 the light panel 1 may preferably be designed in the form of two separate slabs, wherein by means of casting or machining a groove has been formed in the surface of each of the slabs such that when they are laid against each other and joined, the desired light channel 3 appears. The joining may be effected for instance by means of fusion, diffusion or adhesive bonding.

By building up the luminous panel 1 by means of several such separate slabs it is easy to provide a plurality of light channels 3 which may be separately located in one or more layers of the matrix 2. The light channel 3 will in every case be constructed integral with the luminous panel 1 and formed of the same material as this. Further it will be understood that the luminous panel is not restricted to having the shape of a rectangular block or slab, but may be given any suitable, desired external shape. The inner wall of the light channel may if desired be coated with a fluorescent substance or a phosphor. Further the light channels are arranged such that they preferably open into the end surfaces of the luminous panel.

By means of methods which are well known in the art the light channels 3 may also be filled with a gas to the desired pressure, and further if desirable, with a metal such as mercury. In the openings of the channel there are provided electrodes 4, and if desired, also drivers (not shown) for the light channels 3. The electrodes may be of the capacitive type as disclosed by Norwegian patent No. 163159 which is the Applicant's own and included herein by reference. The drivers may further be any type known to persons skilled in the art and suitable for driving state-of-the art gas discharge tubes.

If capacitive electrodes are used, the light channel 3 may be sealed with the same material as that of the matrix, and it is then not necessary to provide electrical leads through the sealing and into the light channel. The driver may in that case be provided on or in the luminous panel 1, for instance in a external recess (not shown) provided in the panel.

The matrix 2 of the luminous panel may be glass, polymer or a ceramic material. It shall be gas tight, shockproof, impact resistant, transparent or translucent, so as to be able to sustain extreme loads of mechanical, thermal or environmental nature, while at the same time not diminishing the light output of the luminous panel. This may be achieved by the matrix 2, apart from being transparent or translucent, also being reinforced or hardened, such that it may be able to withstand the loads of the above-mentioned type. The matrix is added or doped with at least one phosphor such that the phosphor is brought to fluorescence when a state of gas discharge occurs in the light channel 3. The effect of this will be that the luminous panel 1 emits a fluorescent light over its total surface, appearing as a surface light source. The effect may then be similar to that which may be achieved by electroluminescent light sources, but the light yield will be far greater and in theory as large as that which is possible to achieve with usual fluorescent tubes. This presupposes a control of the distribution of the phosphor in the matrix, which may be attained by using known methods. The phosphor may for instance be distributed on or at the surface of the matrix or evenly in the matrix. In order to provide a surface light source with a near isophotic surface luminance, however, the distribution of the phosphor should take into account the absorption of the primary emission from the gas discharge source both by the matrix as well as the phosphor itself. Further the matrix must then consist of a material which to a small degree absorbs ultraviolet and short wave light, for instance quartz. Also the light channel may as mentioned be coated internally with phosphor.

The light channel 3 may be a separate element, for instance a glass tube. This separate element will then be cast or forced into the matrix 2, but can nevertheless be made of the same material as the matrix.

Figure 3:
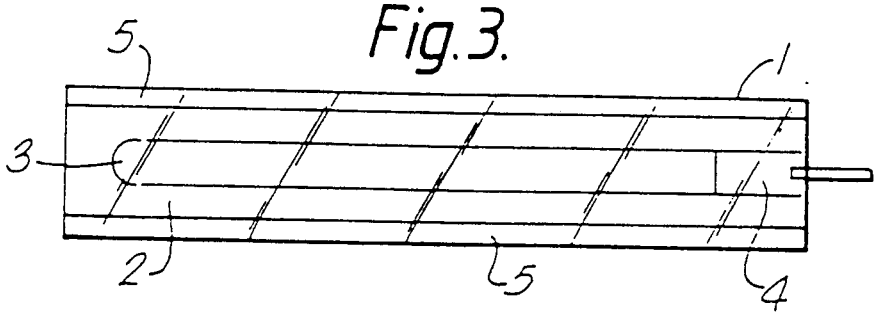
FIG. 3 shows an elevation view of a light panel surrounded by sheets at its two largest surfaces.
Figure 4:
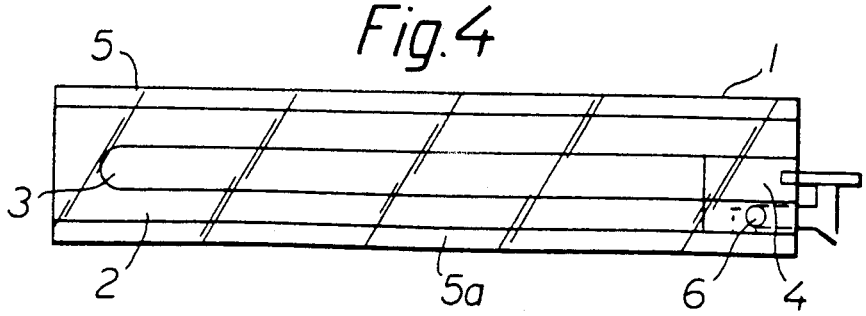
FIG. 4 shows an elevational view of a light panel including a solar cell and a battery.

In FIG. 3 there is shown a different, preferred embodiment, wherein the matrix 2 is surrounded by sheets or layers 5. The sheets 5 may be made of a similar material as the matrix 2, i.e. being transparent or translucent and in addition reinforced or hardened such that they are able to withstand large external loads, for instance mechanical loads. The sheets 5 are joined or laminated to the matrix of the luminous panel by known methods, for instance by fusion or adhesive bonding. The purpose of the sheets 5 is to furnish the luminous panel 1 with an additional protection beyond that which may be achieved by the matrix alone, or the sheets 5 may also have an aesthetic function, where or when the use of the luminous panels 1 makes this desirable. Further the sheets 5 similarly to the matrix 2 may be doped with phosphor such that they together with the matrix function as a fluorescent light source. In this case the sheets 5 must be made of a material which allows transmission of short wave and ultraviolet light, but may at the same time be surface treated such that short wave and ultraviolet light radiation do not escape from the luminous panel 1. Usually the sheets 5, however, are provided with the primary purpose as mentioned above, namely strengthening the luminous panel 1 and making it more resistant to external loads.

Depending on the intended application, the embodiment of the luminous panel may be varied as regards material usage, shape and for instance the number of light channels 3. In one embodiment there may be provided several separate channels in the luminous panel 1. If several separate channels with individually fitted electrodes are used, the channels may be arranged in several layers and for instance used for creating a pattern in the luminous panel 1 where in this case the matrix 2 is not doped with phosphor. The pattern created by the light channels 3 may then be used for reproducing alfa-numeric characters in order that the luminous panels can be used in information displays and the like.

In certain applications, for instance in connection with emergency lighting and for traffic purposes, it may be advantageous that the luminous panel can be driven by batteries 6 or photo-voltaic elements, such as a solar cell 5*a*. Preferably, there may be used a combination with one or more rechargeable electrical batteries which are provided in the luminous panel and connected with both the photo-voltaic elements and the light source. The rechargeable electrical battery will then be charged by the photo-voltaic elements when this is appropriate, and will drive the luminous panel independent of external power supply or in case of interruption of an external power supply.

If photo-voltaic elements 5a are used in the luminous panel, these may be arranged in such a way in the matrix that they are activated when they are illuminated, for instance by solar light. Photo-voltaic elements may also be provided on one or more of the surrounding sheets 5 and in one embodiment be arranged such that they are facing the light channel 3 of the luminous panel. During normal operation of the luminous panel 1 the light emitted from the light channel 3, or the matrix 2 activates the photo-voltaic elements which then may be used for charging a rechargeable electrical battery for emergency power supply. The photo-voltaic elements may also be arranged such that they are facing away from the light channels and for instance towards a possible external light source, usually direct solar light or daylight.

As a rule it will be practical that the photo-voltaic elements used are solar cells which may be bought from any recognized supplier of such. If the solar cells are arranged in a solar cell panel, this may be joined directly to the luminous panel and where it is practical be placed such that the solar cells are protected by the external sheets which are shown in FIG. 3.

In the illustrated embodiments the luminous panels are maintenance-friendly. Ideally, the expected life time for a luminous panel according to the invention may be up to 20 years, but depending on how the luminous panel has been built in, mounted or operated, it is possible to perform different types of maintenance. The light channels may for instance be opened and gas may then be recharged or the phosphor replaced on the inside of the light channels. Components of the driver may likewise be replaced, and if one or more rechargeable electrical batteries are used in connection with the luminous panel, they may be located so as to be easily replaceable.

I claim:

1. Luminous panel with a light source preferably based on gas discharge, wherein the luminous panel comprises a matrix in the form of a gas tight, shockproof, impact resistant, transparent or translucent material, and the light source is designed as at least one light channel in the matrix, wherein the matrix is doped with at least one phosphor, the phosphor having a controlled distribution in the matrix.

2. Luminous panel according to claim 1, wherein it comprises a plurality of light channels which are separately arranged in one or more layers in the matrix.

3. Luminous panel according to claim 1 wherein the luminous panel has an arbitrary, desired external shape.

4. Luminous panel according to claim 1 wherein the light channel is made integral with the luminous panel and of substantially the same material as the luminous panel.

5. Luminous panel according to claim 1 wherein the light channel is embedded in the luminous panel by casting or intrusion, for instance of a gas discharge tube.

6. Luminous panel according to claim 1 wherein the luminous panel further comprises at least one sheet or layer of hardened, shockproof, impact resistant, transparent or translucent material which is joined or laminated to the matrix, preferably by fusion or adhesive bonding.

7. Luminous panel according to claim 1 wherein the matrix is made of glass, polymer or ceramic material.

8. Luminous panel according to claim 1 wherein the phosphor is provided on or adjacent to the surface of the light channel.

9. Luminous panel according to claim 1 wherein the phosphor is provided evenly distributed in the matrix.

10. Luminous panel according to claim 6, wherein the sheet is made of glass, polymer or ceramic material.

11. Luminous panel according to claim 10, wherein the sheet is doped with phosphor.

12. Luminous panel according to claim 6 wherein the luminous panel comprises photo-voltaic elements provided in the matrix or in one or more sheet and arranged such that they are facing towards the light channel of the luminous panel or away from the luminous panel.

13. Luminous panel according to claim 12, wherein the photo-voltaic elements are solar cells.

14. Luminous panel according to claim 13, wherein the solar cells are provided in a solar cell panel joined to the luminous panel.

15. Luminous panel according to claim 12 wherein a replaceable and rechargeable electrical battery is provided in the luminous panel and electrically connected with the photo-voltaic elements and the light source, respectively.

16. Luminous panel according to claim 2 wherein the luminous panel has an arbitrary, desired external shape.

17. Luminous panel according to claim 2 wherein the light channel is made integral with the luminous panel and of substantially the same material as the luminous panel.

18. Luminous panel according to claim 3 wherein the light channel is made integral with the luminous panel and of substantially the same material as the luminous panel.

19. Luminous panel according to claim 2 wherein the light channel is embedded in the luminous panel by casting or intrusion, for instance of a gas discharge tube.

20. Luminous panel according to claim 3 wherein the light channel is embedded in the luminous panel by casting or intrusion, for instance of a gas discharge tube.

21. Luminous panel according to claim 5 wherein the luminous panel further comprises at least one sheet or layer of hardened, shockproof, impact resistant, transparent or translucent material which is joined or laminated to the matrix, preferably by fusion or adhesive bonding.

22. Luminous panel according to claim 13 wherein a replaceable and rechargeable electrical battery is provided in the luminous panel and electrically connected with the photo-voltaic elements and the light source, respectively.

23. Luminous panel as in claim 14 wherein a replaceable and rechargeable electrical battery is provided in the luminous panel and electrically connected with the photo-voltaic elements and the light source, respectively.

24. Luminous panel according to claim 1 wherein the phosphor is provided evenly distributed in the matrix.

25. Luminous panel according to claim 1 wherein the phosphor is provided at or near the surface of the matrix.

* * * * *